US012680177B2

(12) United States Patent
Hong et al.

(10) Patent No.: US 12,680,177 B2
(45) Date of Patent: Jul. 14, 2026

(54) METHOD OF PRODUCING GLUCARIC ACID AND METHOD OF MANUFACTURING SYNTHETIC RESIN RAW MATERIAL BY ELECTROCHEMICAL TREATMENT

(71) Applicants: HYUNDAI MOTOR COMPANY, Seoul (KR); KIA CORPORATION, Seoul (KR); KOREA RESEARCH INSTITUTE OF CHEMICAL TECHNOLOGY, Daejeon (KR)

(72) Inventors: Chae Hwan Hong, Seoul (KR); Hyeon Gook Kim, Daejeon (KR)

(73) Assignees: HYUNDAI MOTOR COMPANY, Seoul (KR); KIA CORPORATION, Seoul (KR); KOREA RESEARCH INSTITUTE OF CHEMICAL TECHNOLOGY, Daejeon (KR)

( * ) Notice: Subject to any disclaimer, the term of this patent is extended or adjusted under 35 U.S.C. 154(b) by 0 days.

(21) Appl. No.: 18/657,512

(22) Filed: May 7, 2024

(65) Prior Publication Data

US 2025/0283228 A1 Sep. 11, 2025

(30) Foreign Application Priority Data

Mar. 5, 2024 (KR) ..... 10-2024-0031164

(51) Int. Cl.
*C25B 3/07* (2021.01)
*C23C 18/12* (2006.01)
(Continued)

(52) U.S. Cl.
CPC ..... *C25B 3/07* (2021.01); *C23C 18/1204* (2013.01); *C25B 3/23* (2021.01); *C25B 9/19* (2021.01); *C25B 11/091* (2021.01); *C25B 11/031* (2021.01)

(58) Field of Classification Search
CPC ..... C25B 3/07; C25B 3/23
(Continued)

(56) References Cited

U.S. PATENT DOCUMENTS 4,341,608 A * 7/1982 St. John ..... C25B 1/04 205/639
9,227,904 B1 1/2016 Hong

FOREIGN PATENT DOCUMENTS

KR 20130012426 A 2/2013
KR 101679914 B1 11/2016

OTHER PUBLICATIONS

Liu et al., "Efficient Electrochemical Production of Glucaric Acid and H2 via Glucose Electrolysis," Nature Communications (Jan. 14, 2020), vol. 11, No. 1, pp. 1-11. (Year: 2020).*
(Continued)

*Primary Examiner* — Edna Wong
(74) *Attorney, Agent, or Firm* — Lempia Summerfield Katz LLC

(57) ABSTRACT

A method of producing glucaric acid by electrochemical treatment includes (a) providing a reactor including a first electrode-containing region and a second electrode-containing region separated by an electrolyte membrane, adding a glucose mixture to any one region of the reactor, and adding an electrolyte solution to both regions of the reactor. The method also includes (b) producing glucaric acid by oxidizing glucose by applying a voltage between the first electrode and the second electrode in the reactor subjected to step (a). The electrode in the region to which the glucose mixture is added includes a catalyst containing tantalum.

9 Claims, 4 Drawing Sheets

(51) Int. Cl.

| | |
|---|---|
| ***C25B 3/23*** | (2021.01) |
| ***C25B 9/19*** | (2021.01) |
| ***C25B 11/091*** | (2021.01) |
| *C25B 11/031* | (2021.01) |

(58) Field of Classification Search
USPC ..... 205/421, 440
See application file for complete search history.

(56) References Cited

OTHER PUBLICATIONS

Moon, T. S. et al., Production of Glucaric Acid from a Synthetic Pathway in Recombinant *Escherichia coli*, Applied and Environmental Microbiology; Feb. 2009; vol. 75; pp. 589-595.

* cited by examiner

METHOD OF PRODUCING GLUCARIC ACID AND METHOD OF MANUFACTURING SYNTHETIC RESIN RAW MATERIAL BY ELECTROCHEMICAL TREATMENT

CROSS-REFERENCE TO RELATED APPLICATION

This application claims, under 35 U.S.C. § 119(a), the benefit of priority to Korean Patent Application No. 10-2024-0031164, filed on Mar. 5, 2024, the entire contents of which are incorporated herein by reference.

BACKGROUND

(a) Technical Field

The present disclosure relates to a method of producing glucaric acid and to a method of manufacturing a synthetic resin raw material by electrochemical treatment.

(b) Background Art

Most chemical products are manufactured from petroleum resources. However, in the face of limited reserves of petroleum resources and environmental problems that inevitably arise from use of such resources, research is ongoing on alternative materials. Such alternative materials derived from biomass such as corn, sugarcane, lignocellulosic plant resources, palm, seaweed, etc. are emerging as important resources.

Biomass-related research and development is also underway in automobile part materials that are highly related to petroleum resources. Currently, projects related to biomass-derived materials are small-scale, and economic feasibility thereof is also lower than that of materials derived from petroleum resources. However, according to a recent report published by Utrecht University in the Netherlands at the request of the European Bioplastics and EPNOE (European Polysaccharide Network of Excellence), it is predicted that the use of biomass-derived materials will rapidly increase over the next 10 years. Specifically, it is predicted that biomass-derived materials are marketable enough to replace up to 90% of materials derived from petroleum resources.

Materials for interior and exterior injection molded parts currently used in automobiles include polypropylene, nylon, polycarbonate, ABS resin, and the like. Polypropylene is used in the greatest amount, followed by nylon (about 15 kg per automobile). When technology for manufacturing nylon is converted into biomass-based technology, a significant ripple effect may be expected.

Among various nylon materials, nylon 66, which is a representative nylon material along with nylon 6, is in great demand due to having excellent properties. However, process technology for producing biomass-derived materials as raw materials is insufficient. Also, technology related to methods of producing glucaric acid as a raw material for adipic acid, which is a monomer thereof, is regarded as important.

SUMMARY OF THE DISCLOSURE

The present disclosure has been made keeping in mind the problems encountered in the related art. An object of the present disclosure is to provide a novel method of producing glucaric acid capable of manufacturing adipic acid, which is a raw material for manufacturing synthetic resin (nylon 66), from glucose as a biomass-derived material.

Another object of the present disclosure is to provide an electrochemical treatment method for producing glucaric acid from glucose that provides ease of production, economic efficiency, and environmental friendliness.

Still another object of the present disclosure is to provide a method of manufacturing a raw material for manufacturing synthetic resin from a biomass-derived material and a monosaccharide containing an aldehyde group and a hydroxyalkyl group.

The objects of the present disclosure are not limited to the foregoing. The objects of the present disclosure should be able to be more clearly understood through the following description and to be realized by the means described in the claims and combinations thereof.

An aspect of the present disclosure provides a method of producing glucaric acid by electrochemical treatment. The method includes step (a) of providing a reactor including a first electrode-containing region and a second electrode-containing region separated by an electrolyte membrane, adding a glucose mixture to any one region of the reactor, and adding an electrolyte solution to both regions of the reactor. The method also includes a step (b) of producing glucaric acid by oxidizing glucose by applying a voltage between a first electrode and a second electrode in the reactor subjected to step (a). The electrode in the region to which the glucose mixture is added includes a catalyst containing tantalum.

Another aspect of the present disclosure provides a method of manufacturing a synthetic resin raw material by electrochemical treatment. The method includes a step (a') of providing a reactor including a first electrode-containing region and a second electrode-containing region separated by an electrolyte membrane, adding a first compound to any one region of the reactor, and adding an electrolyte solution to both regions of the reactor. The method also includes the step (b') of manufacturing a second compound by oxidizing the first compound by applying a voltage between a first electrode and a second electrode in the reactor subjected to step (a'). The first compound includes a linear monosaccharide containing an aldehyde group and a C1-C3 hydroxyalkyl group or a cyclic monosaccharide convertible into the linear monosaccharide. The second compound contains a carboxyl group. The electrode in the region to which the first compound is added includes a catalyst containing tantalum.

BRIEF DESCRIPTION OF THE DRAWINGS

The above and other features of the present disclosure are described in detail referring to certain embodiments thereof illustrated in the accompanying drawings, which are given hereinbelow by way of illustration only, and thus are not limitative of the present disclosure, and wherein.

DETAILED DESCRIPTION

Figure 1:
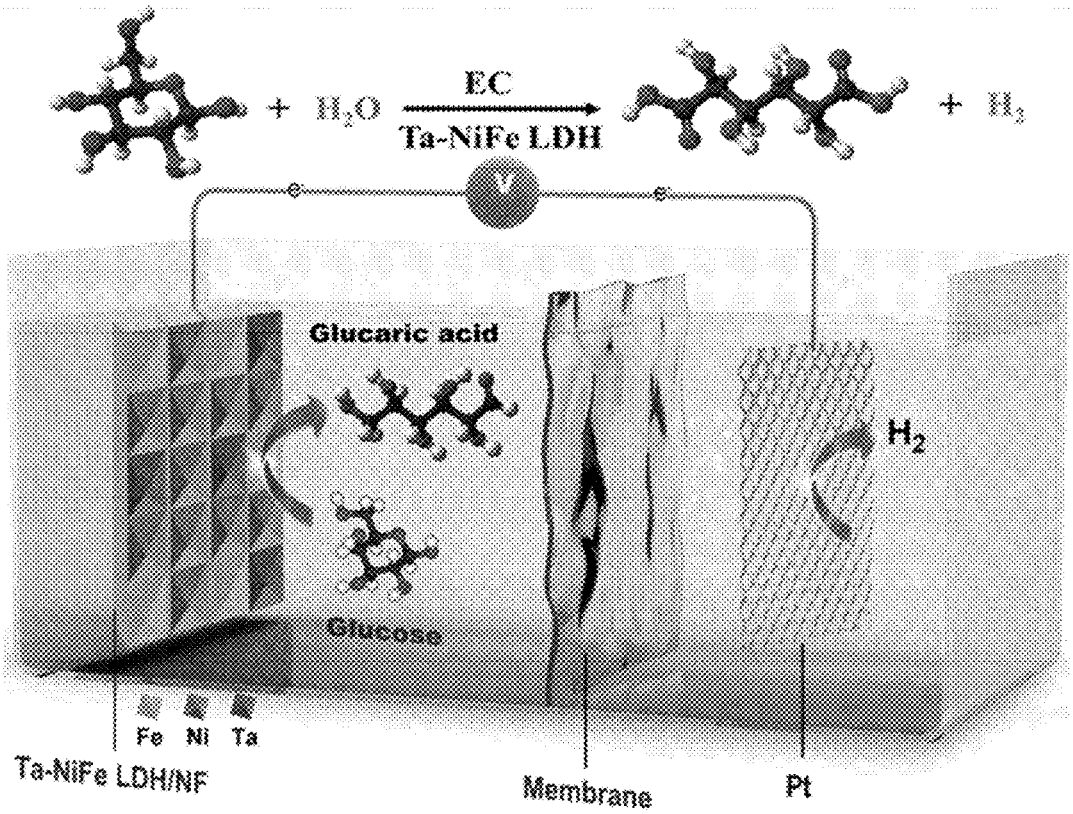
FIG. 1 schematically shows a process of producing glucaric acid by electrochemical treatment according to an aspect of the present disclosure.

The above and other objects, features, and advantages of the present disclosure should be more clearly understood from the following embodiments taken in conjunction with the accompanying drawings. However, the present disclosure is not limited to the embodiments disclosed herein and the embodiments may be modified into different forms. These embodiments are provided to thoroughly explain the disclosure and to sufficiently transfer the spirit of the present disclosure to those having ordinary skill in the art.

Throughout the drawings, the same reference numerals refer to the same or like elements. For the sake of clarity of the present disclosure, the dimensions of structures may be depicted as being larger than actual size. It should be understood that, although terms such as "first", "second", etc. may be used herein to describe various elements, these elements are not to be limited by these terms. These terms are only used to distinguish one element from another element. For instance, a "first" element discussed below could be termed a "second" element without departing from the scope of the present disclosure. Similarly, the "second" element could also be termed a "first" element. As used herein, the singular forms are intended to include the plural forms as well, unless the context clearly indicates otherwise.

It should be further understood that terms such as "comprise", "include", "have", and variations thereof, when used in this specification, specify the presence of stated features, integers, steps, operations, elements, components, or combinations thereof. Such terms do not preclude the presence or addition of one or more other features, integers, steps, operations, elements, components, or combinations thereof. Also, it should be understood that, when an element such as a layer, film, area, or sheet is referred to as being "on" another element, it may be directly on the other element, or intervening elements may be present therebetween. Similarly, when an element such as a layer, film, area, or sheet is referred to as being "under" another element, it may be directly under the other element, or intervening elements may be present therebetween.

Unless otherwise specified, all numbers, values, and/or representations that express the amounts of components, reaction conditions, polymer compositions, and mixtures used herein are to be taken as approximations including various uncertainties affecting measurement that inherently occur in obtaining these values, among others. Thus, such numbers, values, and/or representations should be understood to be modified by the term "about" in all cases. Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated.

In producing D-glucaric acid using D-glucose, a method of producing D-glucaric acid by microbial fermentation or chemical oxidation has problems such as toxic oxidizing agents, various byproducts, high-temperature and high-pressure application, etc. and has low economic efficiency or complicated production processes.

In order to attain economic efficiency and simplify the production process, a method is devised of producing D-glucaric acid from D-glucose in an electrochemical cell or reactor to which an electrode including a catalyst containing tantalum is applied. The method is described in detail below.

Method of Producing Glucaric Acid by Electrochemical Treatment

Figure 2:
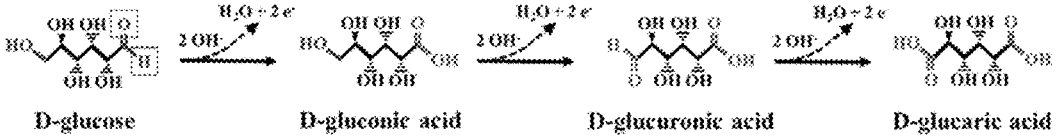
FIG. 2 schematically shows reaction of raw material and intermediates in the process of producing glucaric acid by electrochemical treatment according to an aspect of the present disclosure.
Figure 5:
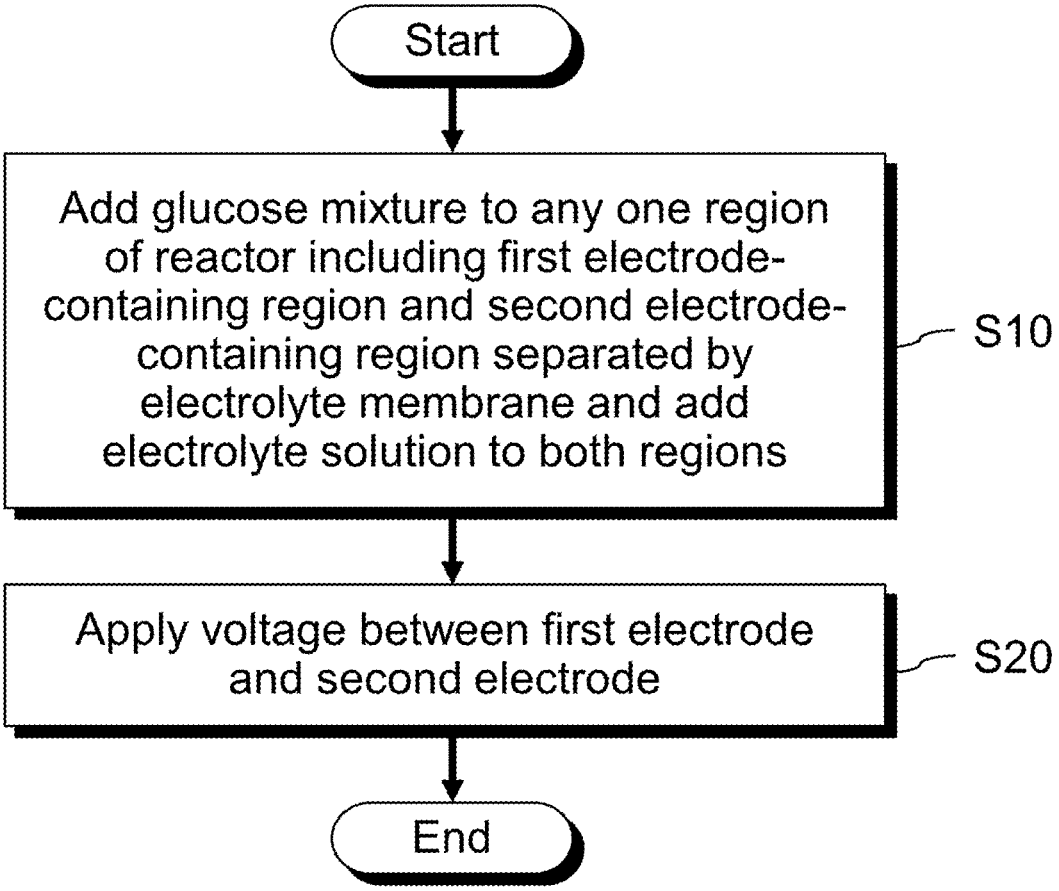
FIG. 5 is a flowchart schematically showing the process of producing glucaric acid by electrochemical treatment according to an aspect of the present disclosure.

Referring to FIGS. 1, 2, and 5, the method of producing glucaric acid by electrochemical treatment according to an aspect of the present disclosure may include a step (a) of providing a reactor including a first electrode in a first electrode-containing region and a second electrode in a second electrode-containing region separated by an electrolyte membrane, adding a glucose mixture to any one region of the reactor, and adding an electrolyte solution to both regions thereof (S10). The method may also include a step (b) of producing glucaric acid by oxidizing glucose by applying a voltage between the first electrode and the second electrode in the reactor subjected to step (a) (S20). The electrode in the region to which the glucose mixture is added may include a catalyst containing tantalum.

The glucose mixture and the electrolyte in step (a) (S10) may be added to immerse the electrodes in the reactor.

The electrolyte solution in step (a) may include alkali metal hydroxide, alkaline earth metal hydroxide, or the like, and may be in the form of an aqueous solution. For example, the electrolyte solution may be an aqueous solution including sodium hydroxide, potassium hydroxide, or the like. The electrolyte solution may vary depending on the electrolyte membrane. When an anion exchange membrane is used as the electrolyte membrane, the electrolyte solution may include alkali metal hydroxide or alkaline earth metal hydroxide. When a cation exchange membrane is used, the electrolyte solution may include water.

The electrolyte solution in step (a) (S10) may be in the form of an aqueous solution having the same electrolyte concentration in both regions. The concentration of the electrolyte may be 0.5 M to 2.0 M.

The first electrode and the second electrode in step (a) (S10) may be spaced apart from each other at a predetermined distance inside the reactor, may be electrically connected to each other outside the reactor, and may each be connected to a voltage application means, a power supply, or the like.

The glucose in step (a) (S10) may be derived from biomass.

The glucose in step (a) (S10) may be in any one form selected from the group comprising or consisting of an acyclic form, a cyclic form, or any combination thereof, which may be mixed in a mixture or an aqueous solution, and the cyclic form may be ring-opened to give a linear or straight-chain form.

The glucose mixture in step (a) (S10) may be, for example, an aqueous solution including D-glucose.

The molar concentration of glucose in the glucose mixture in step (a) (S10) may be in a range of 0.03 M to 0.2 M, or more specifically, in a range of 0.05 M to 0.1 M. If the molar concentration thereof is less than 0.03 M, economic efficiency may deteriorate due to the low concentration of the material to be treated. If the molar concentration thereof exceeds 0.2 M, unnecessary side reactions may occur.

The first electrode in step (a) (S10) may be an anode (oxidation electrode) and the second electrode may be a cathode (reduction electrode). The catalyst may be disposed on the anode.

As shown in FIG. 1, the reactor in step (a) (S10) may be partitioned into the first electrode (anode)-containing region and the second electrode (cathode)-containing region by the electrolyte membrane.

The electrolyte membrane disposed in the reactor in step (a) (S10) may be, for example, an anion conductive electrolyte membrane and may have an amine group introduced thereinto. Alternatively, the electrolyte membrane may be a cation conductive electrolyte membrane and may have a sulfonic acid group introduced thereinto.

The catalyst in step (a) (S10) may include tantalum-doped layered double hydroxide, may include different types of metals, and may include divalent and trivalent metals. For example, the catalyst may include nickel and iron.

The second electrode, the cathode, in step (a) (S10) may include a noble metal selected from the group comprising or consisting of platinum, gold, silver, iridium, palladium, ruthenium, rhodium, or any combination thereof, and may include, for example, platinum.

The tantalum-doped layered double hydroxide in step (a) (S10) may be manufactured by a method including (i) adding a nickel structure to a mixture of a nickel precursor, an iron precursor, and an amine compound with a solvent and performing heat treatment and (ii) mixing the result of step (i) and a tantalum precursor and performing hydrothermal treatment.

The nickel precursor in step (i) may include nickel nitrate and hydrates thereof and may include $Ni(NO_3)_2 6H_2O$ (where Ni=nickel, N=nitrogen, O=oxygen, H=hydrogen).

The iron precursor in step (i) may include iron nitrate and hydrates thereof and may include $Fe(NO_3)_3 9H_2O$ (where Fe=iron).

The amine compound in step (i) may include, for example, urea ($CO(NH_2)_2$).

The nickel structure in step (i) may include porous nickel and may be, for example, nickel foam.

The nickel structure in step (i) may be sonicated in an acid solution. The acid solution may be a hydrochloric acid solution, the concentration thereof may be in a range of 10 weight percent (wt %) to 50 wt % and the sonication time may be in a range of 1 minute to 30 minutes. The acid-treated nickel structure may be washed with absolute ethanol, deionized water, or the like for 1 to 10 minutes.

The solvent in step (i) may include water and the nickel precursor, the iron precursor, and urea may be completely dissolved in the mixture.

When mixing the nickel precursor and the iron precursor in step (i), a molar ratio of nickel to iron may be in a range of 1:0.1 to 1:1.

When mixing the metal (nickel, iron) precursors and urea in step (i), a molar ratio of metal to urea may be in a range of 1:3 to 1:8.

The heat treatment temperature in step (i) may be in a range of 100° C. to 150° C. As such, heat treatment may be performed using an autoclave or the like.

Step (i) may further include cooling to room temperature (20-30° C.) after heat treatment and ultrasonic treatment, washing, and drying after cooling. The drying may be performed at 50° C. to 90° C. for 2 to 10 hours.

Nickel-iron layered double hydroxide may be formed in step (i).

The tantalum precursor in step (ii) may include tantalum chloride ($TaCl_5$).

In step (ii), a mixed solution of the tantalum precursor and water at a weight ratio of 1:2 to 1:5 may be prepared and mixed with the result of step (i). There is no limit to the amount of tantalum precursor added. However, the molar proportion of tantalum may be 0.01 or more times the total molar amount of nickel and iron in the result of step (i).

The hydrothermal treatment in step (ii) may be performed for 10 to 100 minutes.

Through hydrothermal treatment in step (ii), a catalyst may be obtained in which tantalum grows, is formed, or is doped on the surface of nickel-iron layered double hydroxide.

The layered double hydroxide that is doped with tantalum by such a method may have superior stability compared to layered double hydroxide that is not doped with tantalum, may remarkably reduce a reaction time at a high glucose molar concentration of 0.05 M or more, and may exhibit a higher glucaric acid production yield within a short time.

The production yield may be calculated as follows.

(Number of moles of material actually produced/ maximum number of moles of material able to be theoretically produced)*100%

The voltage in step (b) (S20) may be in a range of 1.2 V to 1.6 V, and more specifically may be in a range of 1.3 V to 1.5 V or in a range of 1.39 V to 1.45 V. If the voltage is less than 1.2 V, the glucaric acid production yield may decrease. If the voltage exceeds 1.6 V, unnecessary side reaction may occur.

Step (b) (S20) may be performed at a temperature in a range of 15° C. to 50° C., or more specifically, in a range of 20° C. to 30° C. If the temperature is lower than 15° C., the time required for reaction may increase. If the temperature is higher than 50° C., unnecessary side reaction may occur.

Step (b) (S20) may be performed for 1 hour to 5 hours, or more specifically, for 1 hour to 3 hours or for 1 hour to 2 hours. Even in such a short period of time, glucaric acid may be produced in high yield.

The production yield may be 10% or more, 50% or more, 78% or more, or 82% or more. The production yield may be 99.9% or less. Even when step (b) (S20) is performed for 3 hours or less, a production yield of 78% or more may be achieved.

As shown in FIG. 2, in step (b) (S20), linear or straight-chain D-glucose in the mixture may be oxidized at the anode as the electrode on which the catalyst is disposed, forming D-gluconic acid, and then forming D-glucaric acid through D-glucuronic acid.

When an anion exchange membrane is used as the electrolyte membrane and hydroxide is used as the electrolyte, oxidation of glucose and intermediates may occur in the presence of hydroxide ions at the anode and water may also be formed. Hydrogen and hydroxide ions may be formed by decomposition of water at the cathode. When a cation exchange membrane is used as the electrolyte membrane and water is used as the electrolyte, hydrogen ions may be formed by decomposition of water at the anode and oxidation of glucose and intermediate may also occur. Hydrogen may be formed by reduction of hydrogen ions at the cathode.

Method of Manufacturing Synthetic Resin Raw Material by Electrochemical Treatment Referring to FIGS. 1, 2, and 5, the method of manufacturing a synthetic resin raw material by electrochemical treatment according to another aspect of the present disclosure may include a step (a') of providing a reactor including a first electrode in a first electrode-containing region and a second electrode in a second electrode-containing region separated by an electrolyte membrane, adding a first compound to any one region of the reactor, and adding an electrolyte solution to both regions thereof.

The method may also include a step (b') of manufacturing a second compound by oxidizing the first compound by applying a voltage between the first electrode and the second electrode in the reactor subjected to step (a'). The first compound may include a linear monosaccharide containing an aldehyde group and a C1-C3 hydroxyalkyl group or a cyclic monosaccharide convertible into the linear monosaccharide. The second compound may contain a carboxyl group. The electrode in the region to which the first compound is added may include a catalyst containing tantalum.

The reactor, electrolyte membrane, electrolyte solution, application conditions, and the like in step (a') may be the same as those in step (a). Thus, a redundant description thereof has been omitted.

The first compound in step (a') may include tetrose to hexose derived from biomass. Examples thereof may include D-erythrose, D-threose, D-ribose, D-arabinose, D-xylose, D-lyxose, D-allose, D-altrose, D-glucose, D-mannose, D-gulose, D-idose, D-galactose, D-talose, or the like, and may include isomers thereof.

The voltage application, electrochemical treatment conditions, production yield, or the like in step (b') may be the same as those in step (b). Thus, a redundant description thereof has been omitted.

The second compound in step (b') may include a final oxide of the first compound and may include, for example, a carboxyl group at both ends.

Through steps (a') and (b'), a raw material that may be applied to manufacture synthetic resin may be easily obtained by a simplified process from the first compound derived from biomass.

Catalyst for Manufacturing Synthetic Resin Raw Material by Electrochemical Treatment A catalyst for manufacturing a synthetic resin raw material by electrochemical treatment according to still another aspect of the present disclosure may be applied to any one electrode when manufacturing a second compound by electrochemically treating a first compound at the first electrode and the second electrode. The first compound may include a linear monosaccharide containing an aldehyde group and a C1-C3 hydroxyalkyl group or a cyclic monosaccharide convertible into the linear monosaccharide, the second compound may contain a carboxyl group, and the catalyst may contain tantalum.

The catalyst may include tantalum-doped nickel-iron layered double hydroxide and is the same as the catalyst described above. Thus, a redundant description thereof has been omitted.

The first compound, the second compound, the method of manufacturing the catalyst, the manufacturing method using the catalyst ((a), (b), (a'), (b')), and the reactor are the same as those described above. Thus, a redundant description thereof has been omitted.

A better understanding of the present disclosure may be obtained through the following examples and comparative examples. However, these examples are not to be construed as limiting the technical spirit of the present disclosure.

Preparation Example—Preparation of Tantalum-Doped Nickel-Iron Layered Double Hydroxide Catalyst $Ni(NO_3)_2 6H_2O$ (0.9 mmol), $Fe(NO_3)_3 9H_2O$ (0.3 mmol), and $CO(NH_2)_2$ (5 mmol) were dissolved in water and then stirred to afford an aqueous solution. Then, nickel foam with a cross-sectional size of 2 cm×3 cm was immersed in a 37 wt % hydrochloric acid solution, sonicated in an ultrasonic bath for 5 minutes to remove the nickel oxide (NiO) layer from the surface thereof, and washed. Thereafter, washing with absolute ethanol and deionized water for 3 minutes was performed.

Next, the aqueous solution and the nickel foam were placed in a 50 ml Teflon-lined stainless steel autoclave, sealed, and treated at 120° C. for 12 hours, then naturally cooled to room temperature (25° C.). This was followed by sonication, washing three times with absolute ethanol and deionized water, and drying at 80° C. for 6 hours to obtain nickel-iron layered double hydroxide.

Figure 3:
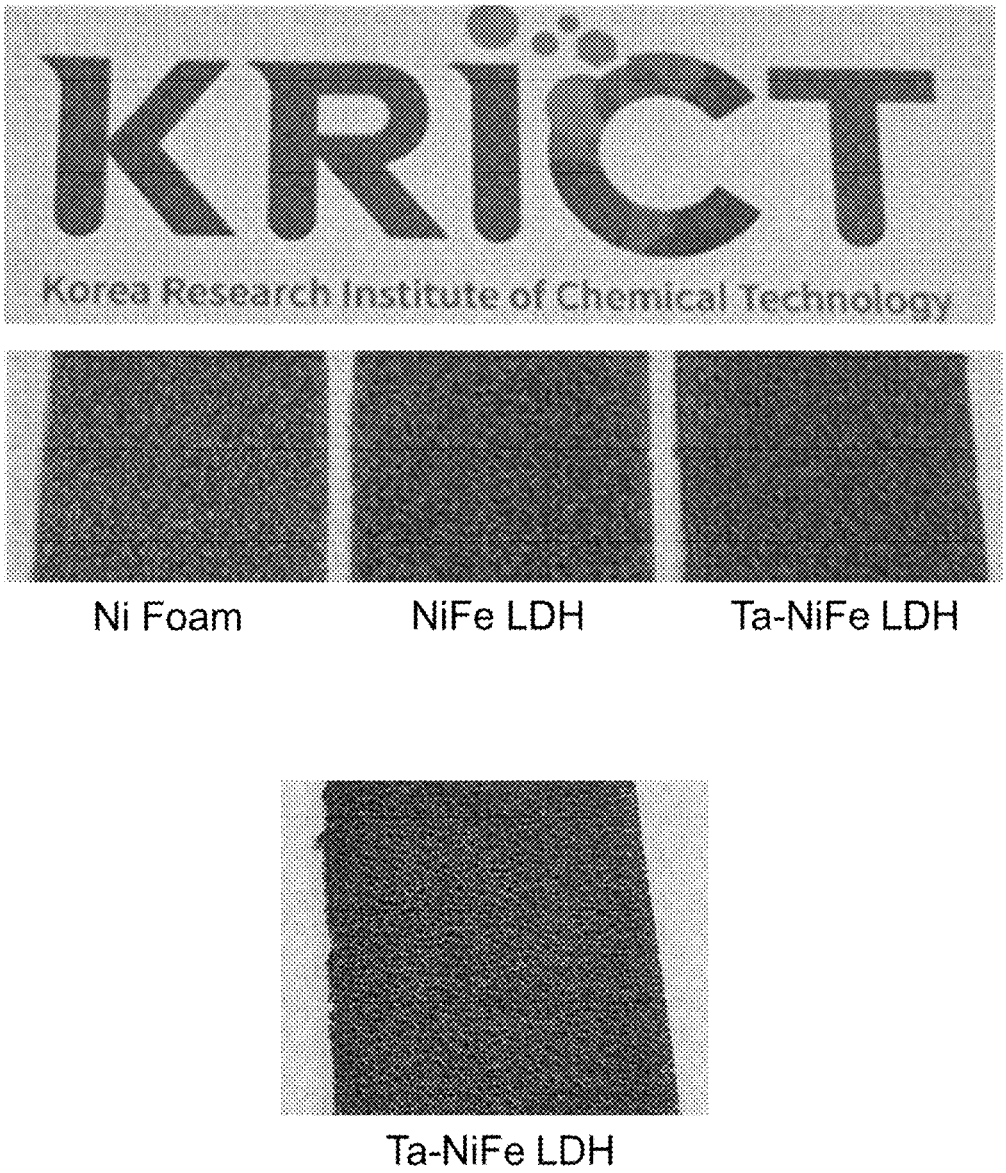
FIG. 3 is a photograph (upper image, from the left) of nickel (Ni) foam, nickel-iron layered double hydroxide (NiFe LDH), and tantalum-doped nickel-iron layered double hydroxide (Ta—NiFe LDH) according to the Preparation Example and is a photograph (lower image) of the tantalum-doped nickel-iron layered double hydroxide in a different appearance.

A mixed solution of tantalum chloride ($TaCl_5$) and water at a weight ratio of 1:3.5 was added to the nickel-iron layered double hydroxide and hydrothermally treated and stirred for 30 minutes to obtain tantalum-doped nickel-iron layered double hydroxide (Ta—NiFe LDH). The result thereof is shown in the lower part of FIG. 3. The upper part of FIG. 3 shows, from the left, the nickel foam, the nickel-iron layered double hydroxide manufactured in step (i), and the tantalum-doped nickel-iron layered double hydroxide.

Example 1

An H-type electrochemical cell (reactor) including an anode-containing region and a cathode-containing region separated by an anion exchange membrane was provided. The tantalum-doped nickel-iron layered double hydroxide manufactured in the Preparation Example was applied to the anode and platinum was applied to the cathode. Then, an aqueous D-glucose solution was added to the anode-containing region and a potassium hydroxide (KOH) electrolyte solution was added to both regions. As such, the concentration of D-glucose was 0.1 M and the concentration of KOH was 1 M.

A voltage of 1.39 V was applied between the anode and the cathode through a power supply, the reactor temperature was maintained at 20° C., and treatment was performed for 2 hours.

Example 2

The present example was performed under the same conditions as in Example 1, with the exception that the concentration of D-glucose in step (a) was changed to 0.05 M.

Example 3

The present example was performed under the same conditions as in Example 1, with the exception that the voltage in step (b) was changed to 1.45 V.

Example 4

The present example was performed under the same conditions as in Example 1, with the exception that the concentration of D-glucose in step (a) was changed to 0.05 M and the voltage in step (b) was changed to 1.45 V.

Comparative Example 1

The present comparative example was performed under the same conditions as in Example 1, with the exception that the anode in step (a) was changed to a nickel layered nanosheet manufactured by MTI Korea.

Comparative Example 2

The present comparative example was performed under the same conditions as in Example 1, with the exception that the anode in step (a) was changed to an iron layered nanosheet manufactured by Foammetal.

Comparative Example 3

The present comparative example was performed under the same conditions as in Example 1, with the exception that the anode in step (a) was changed to the nickel-iron layered double hydroxide manufactured in step (i) of Preparation Example.

Comparative Example 4

The present comparative example was performed under the same conditions as in Example 1, with the exception that the voltage in step (b) was changed to 1.0 V.

The treatment conditions of the Examples and Comparative Examples are briefly compared in Table 1 below.

TABLE 1

| Classification | (a) Glucose concentration (M) | (a) Anode (catalyst) | (b) Voltage (V) |
|---|---|---|---|
| Example 1 | 0.1 | Ta-NiFe LDH | 1.39 |
| Example 2 | 0.05 | Ta-NiFe LDH | 1.39 |
| Example 3 | 0.1 | Ta-NiFe LDH | 1.45 |
| Example 4 | 0.05 | Ta-NiFe LDH | 1.45 |
| Comparative Example 1 | 0.1 | Ni layered nanosheet structure | 1.39 |
| Comparative Example 2 | 0.1 | Fe layered nanosheet structure | 1.39 |
| Comparative Example 3 | 0.1 | NiFe LDH | 1.39 |
| Comparative Example 4 | 0.1 | Ta-NiFe LDH | 1.0 |

Test Example 1—NMR Analysis and Yield Measurement

Figure 4:
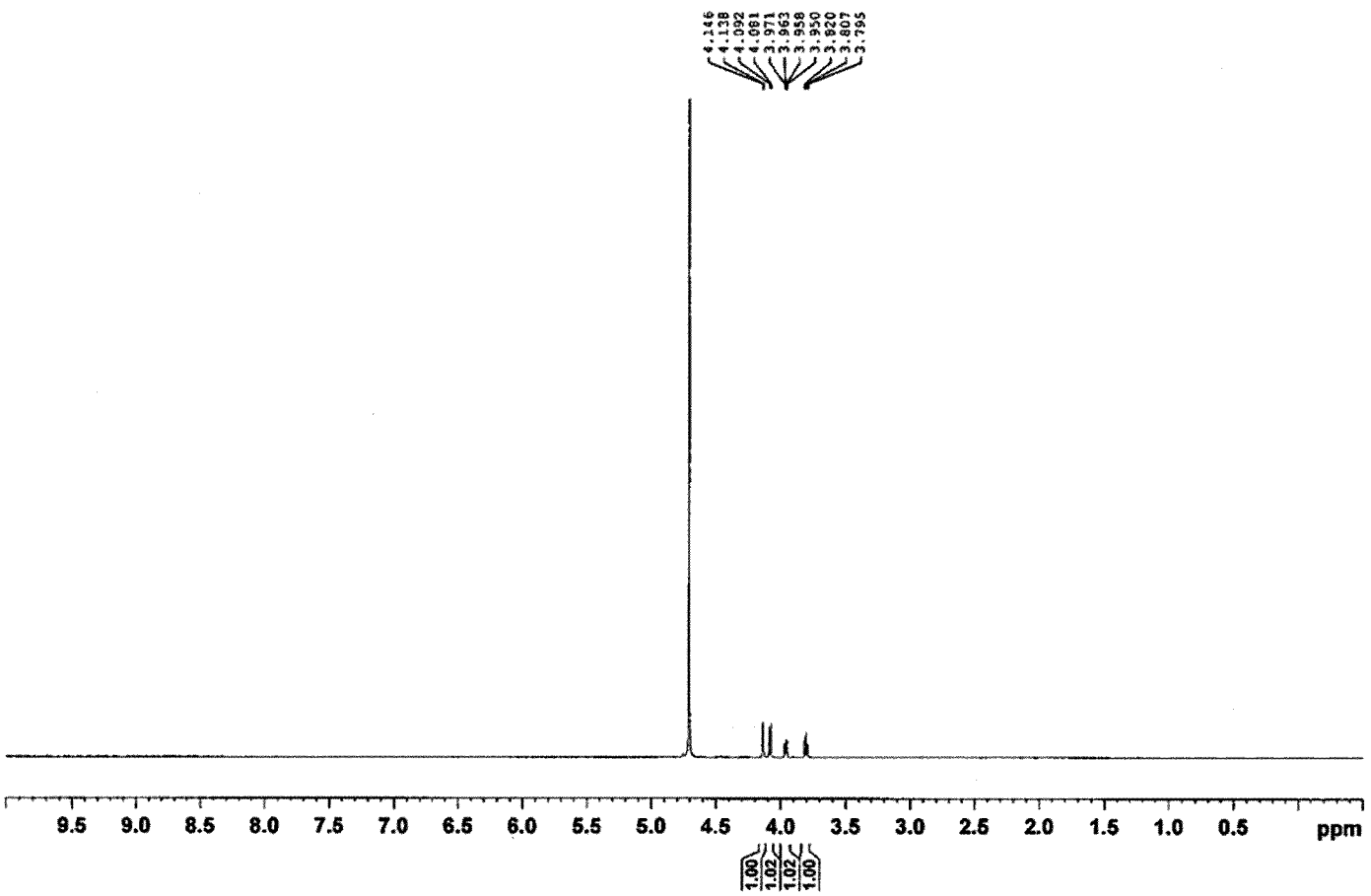
FIG. 4 shows NMR spectrum results in Test Example 1 of the present disclosure.

In order to confirm the components obtained in the Examples and Comparative Examples, nuclear magnetic resonance spectroscopy (NMR) was performed using a Bruker AVIII400 instrument. Measurement was conducted in D20 containing TMS (trimethylsilane) as an internal standard (1H at 400 MHz, 13C at 100 MHz). In the Examples, the results of FIG. 4 were obtained.

Peak positions: 1H NMR δ 4.14 (d, J=3.2, 1H), 4.09 (d, J=4.4, 1H), 3.96 (dd, J=3.2, 1H), 3.80 (apparently t, J=5.0)

Also, the production yields of glucaric acid in the Examples and Comparative Examples are shown in Table 2 below.

TABLE 2

| Classification | Yield (%) |
|---|---|
| Example 1 | 83 |
| Example 2 | 83 |
| Example 3 | 83 |
| Example 4 | 83 |
| Comparative Example 1 | 0 |
| Comparative Example 2 | 0 |
| Comparative Example 3 | 0 |
| Comparative Example 4 | 0 |

Referring to Table 2, in the Examples in which the catalyst doped with tantalum was used and the appropriate voltage was applied, a glucaric acid production yield of 80% or more for 2 hours was achieved. In cases in which the catalyst doped with tantalum was not used or the voltage outside the appropriate voltage range was applied, it was difficult to obtain glucaric acid within 2 hours.

As is apparent from the above description, according to the present disclosure, glucaric acid, which is a raw material for manufacturing synthetic resin (nylon 66), can be produced by a novel method from glucose as a biomass-derived material.

In addition, when producing glucaric acid from glucose, ease of production, economic efficiency, and environmental friendliness can be attained compared to methods using microorganisms or applying simple catalysts.

In addition, a raw material for manufacturing synthetic resin can be easily manufactured from a biomass-derived material containing an aldehyde group and a C1-C3 hydroxyalkyl group.

In addition, the present disclosure can be employed in technology for manufacturing adipic acid, a monomer of nylon 66, which is used as a material for automobile parts, from glucaric acid.

The effects of the present disclosure are not limited to the above-mentioned effects. It should be understood that the effects of the present disclosure include all effects that can be inferred from the description of the present disclosure.

Although specific embodiments of the present disclosure have been described, those skilled in the art will appreciate that the embodiments of the present disclosure may be embodied in other specific forms without changing the technical spirit or essential features thereof. Thus, the embodiments described above should be understood to be non-limiting and illustrative in every way.

What is claimed is:

1. A method of producing glucaric acid by electrochemical treatment, the method comprising:

(a) providing a reactor including a first electrode of a first electrode-containing region and a second electrode of a second electrode-containing region separated by an electrolyte membrane, adding a glucose mixture to any one region of the first or second electrode-containing regions of the reactor, and adding an electrolyte solution to both the first and second electrode-containing regions; and (b) producing glucaric acid by oxidizing the glucose mixture by applying a voltage between the first electrode and the second electrode in the reactor subjected to step (a), wherein the first or second electrode in the one region to which the glucose mixture is added includes a catalyst containing tantalum, wherein, in step (a), the first electrode is an anode, the second electrode is a cathode, and the anode comprises the catalyst, and wherein the catalyst in step (a) comprises a layered double hydroxide doped with the tantalum.

2. The method of claim 1, wherein the glucose mixture in step (a) is an aqueous solution comprising D-glucose.

3. The method of claim 1, wherein a molar concentration of glucose in the glucose mixture in step (a) is in a range of 0.05 M to 0.1 M.

4. The method of claim 1, wherein the layered double hydroxide in step (a) comprises nickel and iron, and wherein the cathode comprises a noble metal comprising platinum, gold, silver, iridium, palladium, ruthenium, rhodium, or any combination thereof.

5. The method of claim 4, wherein the layered double hydroxide in step (a) is manufactured by a method comprising:

(i) adding a nickel structure to a mixture of a nickel precursor, an iron precursor, and an amine compound and performing heat treatment; and (ii) mixing a result of step (i) and a tantalum precursor and performing hydrothermal treatment.

6. The method of claim 5, wherein the tantalum precursor in step (ii) comprises tantalum chloride ($TaCl_5$).

7. The method of claim 1, wherein the voltage in step (b) is in a range of 1.2 V to 1.6 V.

8. The method of claim 1, wherein step (b) is performed at a temperature in a range of 15° C. to 50° C. for 1 hour to 5 hours.

9. The method of claim 1, wherein step (b) is performed for 3 hours or less, and a production yield of glucaric acid from glucose is 78% or more.

* * * * *